US005392741A

United States Patent [19]

Uzkan

[11] Patent Number: 5,392,741

[45] Date of Patent: Feb. 28, 1995

[54] LOCOMOTIVE ENGINE COOLING SYSTEM

[75] Inventor: Teoman Uzkan, Indian Head Park, Ill.

[73] Assignee: General Motors Corporation, Detroit, Mich.

[21] Appl. No.: 168,352

[22] Filed: Dec. 17, 1993

[51] Int. Cl.[6] ..... F01P 7/02

[52] U.S. Cl. ..... 123/41.13; 123/41.15; 290/3; 290/40 C

[58] Field of Search ..... 123/41.01, 41.13, 41.15, 123/198 D; 290/40 B, 40 C, 40 R, 3

[56] References Cited

U.S. PATENT DOCUMENTS 5,133,303 7/1992 Umehara ..... 123/41.15

*Primary Examiner*—Noah P. Kamen

*Attorney, Agent, or Firm*—Howard N. Conkey

[57] ABSTRACT

A water cooling system for a locomotive engine that enables the engine to operate at a maximum power level that generates a maximum permissible engine cooling water temperature corresponding to a particular ambient air temperature. The water cooling system can be either an open-loop or a closed-loop controlled system. In the open-loop control system, an ambient air temperature sensor measures the ambient air temperature. When the ambient air temperature exceeds a predetermined value, a signal from the temperature sensor to a signal processor automatically causes the engine power to derate in accordance with the temperature such that the heat generated by the engine maintains the water temperature of the cooling water constant. An ambient pressure sensor senses ambient pressure such that a correction factor is supplied to correct for cooling losses at higher altitude. In the closed loop system, the signal processor generates an error signal as the difference in the maximum allowable engine-out water temperature and the measured water temperature. The signal processor then generates a signal causing the engine power to derate such that the heat generated by the engine maintains the water temperature near the specified design limit. A throttle notch 8 to 6 knock-down cooling procedure is also incorporated as a safety mechanism in the event that the other cooling system fails.

22 Claims, 1 Drawing Sheet

LOCOMOTIVE ENGINE COOLING SYSTEM

BACKGROUND OF THE INVENTION

1. Field of the Invention

This invention relates generally to a cooling system for cooling a locomotive engine and, more particularly, to a cooling system for cooling a locomotive engine that maintains engine power for traction during high ambient temperature conditions. 2. Discussion of the Related Art As is well understood, train locomotives, such as diesel electric locomotives, used to move railway cars along a dual rail configuration are propelled by exerting torque to drive wheels associated with the locomotive that are in contact with the rails. The power to propel the diesel electric locomotive is developed first as mechanical energy by a high horsepower diesel engine. The diesel engine drives a generator that converts the mechanical energy to electrical energy. The electrical energy is transferred to traction motors which convert the electrical energy back to mechanical energy in order to drive axles connected to the drive wheels. In most applications, one traction motor drives each axle of the locomotive. Each axle is rigidly connected to its respective motor and rotates independently of the other axles. Friction between the drive wheels of the locomotive and the rails provide the traction for causing movement of the locomotive and the railway cars.

Economic and safety considerations place requirements on the durability and reliability of the operating life of the engine and its components. These requirements in turn impose restrictions on the maximum prolonged operating temperature of the engine components in order to sustain the operating life. If the engine components are to be exposed to temperatures higher than the set maximum operating temperature during operation of the engine, then it is necessary to reduce the temperature of the components to an acceptable level by providing engine cooling. Therefore, all train locomotives incorporate some procedure for cooling the engine.

In a locomotive engine, cooling of the engine components is usually provided by water cooling. FIG. 1 shows a block diagram of the basic components of a typical water cooling system 10 for cooling a locomotive engine 12. As an example, this type of water cooling system can be found on an F59PHMI locomotive, but it will be understood that the water cooling system 10 is indicative of cooling systems found on many other types of locomotives. Power generated by the engine 12 causes a drive shaft 14 connected to the engine 12 to be rotated. The drive shaft 14 is coupled by a coupler 16 to a drive shaft 18 connected to the armature of a generator 20. The generator 20 is electrically connected to a series of traction motors (not shown) which convert the electrical energy back to mechanical energy to cause the drive wheels (not shown) of the locomotive to rotate in order to propel the locomotive. The operation of generating and transferring power by a locomotive engine to the drive wheels of the locomotive is well understood in the art.

The heat generated by the engine 12 is transferred to water circulating through a water loop 22 of the cooling system 10. A water pump 24 provides the water circulation and transfers the heated water from the engine 12 through the water loop 22 to a radiator 28. A water temperature sensor 26 senses the temperature of the cooling water in the water loop 22 after the water leaves the engine 12. The radiator 28 includes a fan 30 that drives ambient air through the radiator 28 in order to transfer the heat of the water in the water loop 22 to the surrounding air. The cooled water is then circulated to other engine components, such as an oil cooler 32, and then back to the engine 12 to be reheated. The specific operation, as well as the different systems involved, in the above-described closed loop water cooling system 10 is well known in the art.

For any particular locomotive engine, there is a maximum design limit of the engine cooling water temperature in order to maintain the temperature of the components of the engine 12 below a maximum threshold limit. Usually, the engine manufacturer sets and recommends this maximum cooling water temperature to be about 210° F. at the water output of the engine 12. As the locomotive travels during normal operation, there may be times when the ambient air is significantly higher than in most other operating conditions. For example, if a train is traveling through a tunnel, the exhaust of a first locomotive may significantly heat the ambient air such that trailing locomotives will be traveling through the higher temperature air. Additionally, high temperature operating conditions would occur in desert travel.

When the ambient air temperature goes up, the temperature of the water in the cooling system 10 also increases as a result of the ambient air not being able to draw as much heat away from the cooling water in the radiator 28, and thus, the capacity of the cooling system 10 to transfer heat from the engine 12 to the ambient air is reduced. Therefore, as a result of the increase in ambient air temperature, the water temperature limit of the cooling water may be caused to extend beyond that which is sufficient for cooling of the engine 12. The increase in the cooling water temperature results in the increase of the temperature of the engine components, possibly beyond permissible limits for durable engine life. Consequently, when such a point is reached, either the cooling capacity of the cooling system must be increased, for example by increasing the speed of the fan 30, or the heat generated by the engine must be decreased by reducing engine power, i.e., engine derating. Usually, at maximum engine power operation, the fan speed is set by the engine speed, therefore reducing the fan speed while maintaining a constant engine speed is generally not practical.

Known engine water cooling systems typically incorporate an engine derating procedure referred to as throttle notch 8 to 6 knock-down. A typical control for a locomotive will include engine power settings that are selected by an engine operator. The settings include ascending power throttle notch locations numbered from 1 to 8. The throttle notch 1 position would be minimum engine power and the notch 8 position would be maximum engine power. For example, in the F59PHMI locomotive, the notch 8 position engine power would produce approximately 3164 brake horsepower (BHP) at 900 RPM, and the notch 6 position engine power would produce approximately 1677 BHP at 730 RPM. This is a reduction in the engine power of about 47%.

Returning to FIG. 1, in the throttle notch 8 to 6 knock-down procedure, when the water temperature as read by the sensor 26 reaches the predetermined maximum value of 210° F., the water temperature sensor 26 provides a signal to a signal processor 34. The signal processor 34 then automatically provides a signal to a generator field 36 of the generator 20. The signal from the signal processor 34 to the generator field 36 causes a decrease in the generator field current which in turn causes the fuel input to the engine 12 to be reduced. By reducing the fuel input to the engine 12, the output power of the engine is reduced, thus reducing the electrical output of the generator 20. After a predetermined time, or when the sensor 26 indicates that the water temperature has been reduced, the signal processor 34 will cause the engine power to be increased to its former value. The operation of adjusting the engine power in this manner is also well understood in the art.

The throttle notch 8 to 6 knock-down process can be shown graphically in FIG. 2. In FIG. 2, engine BHP is given on the vertical axis and the ambient air temperature in degrees fahrenheit is given on the horizontal axis. The engine BHP at the notch 8 position and the notch 6 position are shown as two horizontal lines indicating a constant engine BHP. Constant water temperature operation (CWTO) lines that indicate a constant cooling water temperature for a particular set of engine BHP and ambient air temperature are also shown. The slope of the CWTO lines are negative, thus indicating that when the ambient air temperature is increased, the engine power for the same maximum cooling water temperature should decrease. For the system being discussed, when the ambient temperature increases and reaches a value $T_1$, and the engine 12 is running at the notch 8 position, the water temperature in the water loop 22 at the output of the engine 12 should reach the maximum value of 210° F. For the F59PHMI cooling system, the $T_1$ value will be approximately 110° F. The system will then automatically reduce the engine control to the notch 6 position, thus significantly reducing the engine power and the amount of heat being generated. As is apparent by following the $T_1$ temperature line from the notch 8 position to the notch 6 position, the cooling water temperature at this notch 6 position is significantly less than the maximum temperature of 210° F.

As discussed above, in the throttle notch 8 to 6 knock-down procedure, when the cooling water temperature reaches a predetermined maximum value as sensed by the sensor 26, the engine power is reduced to a value consistent with the notch 6 position so as to reduce the heat generated by the engine 12, and thus reduce the temperature of the cooling water to an acceptable level. However, the locomotive traction power is also reduced when the engine is derated from the notch 8 position to the notch 6 position because the engine power driving the generator 20 is considerably less. Therefore, the speed of the locomotive is significantly reduced. Additionally, the engine cooling capacity is reduced because the fan speed is proportional to the engine speed. Consequently, although the cooling water temperature is reduced by reducing the engine power, other undesirable effects are also realized with this significant reduction in engine power.

What is needed is an engine cooling system for use in a locomotive which is capable of maintaining maximum engine power and traction without exceeding a maximum engine cooling temperature. It is therefore an object of the present invention to provide such a cooling system.

SUMMARY OF THE INVENTION

In accordance with the teachings of the present invention, a locomotive engine water cooling system is proposed which enables the engine to operate at a maximum power level that generates the maximum permissible engine cooling water temperature corresponding to the present ambient air temperature. The proposed engine cooling system can either be an open-loop control system or a closed loop control system.

In the open-loop system, the engine water cooling system includes an air temperature sensor for measuring the temperature of the ambient air and an air pressure sensor for measuring the pressure of the ambient air. If the ambient air temperature increases to a predetermined value that would reduce the cooling capacity of the cooling system enough to cause the temperature of the cooling water to increase beyond a maximum safe limit, the output of the ambient temperature sensor will cause a signal processor to reduce the engine power in accordance with a system model such that the temperature of the cooling water will be maintained substantially constant at the maximum safe limit. The ambient pressure sensor provides a correction factor signal to the signal processor in or to correct for the diminished cooling capabilities of the cooling system at higher altitudes.

In the closed loop system, the air temperature sensor and the air pressure sensor can be eliminated. The water temperature sensor provides a signal to the signal processor as an indication of the actual cooling water temperature. Once the cooling water goes beyond the maximum safe limit, the signal processor will generate an error signal as the difference between the cooling water temperature and the maximum safe cooling water temperature. The generated error signal will cause the engine power to be reduced in order to reduce the temperature of the cooling water such that the error signal decreases to zero and the water temperature is maintained substantially constant at the safe limit.

A throttle notch 8 to 6 knock-down engine derating procedure is still maintained in both the open and closed loop systems as a safety feature in the event of failure of the continuous water temperature cooling systems.

Additional objects, advantages, and features of the present invention become apparent from the following description and appended claims, taken in conjunction with the accompanying drawings.

DETAILED DESCRIPTION OF THE PREFERRED EMBODIMENTS

The following description of the preferred embodiments concerning a water cooling system for a locomotive engine is merely exemplary in nature and is in no way intended to limit the invention or its applications or uses.

Figure 1:
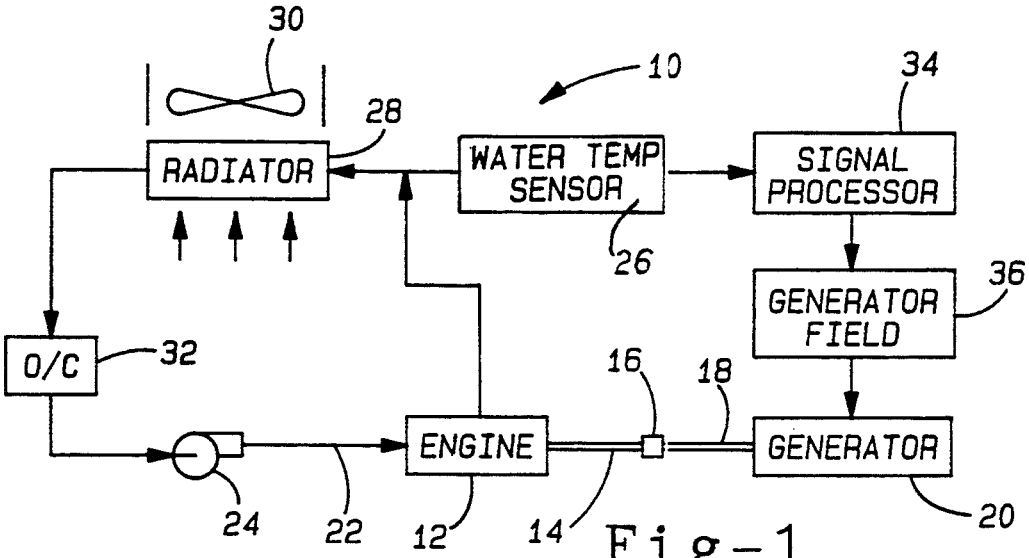
Fig-1 PRIOR ART
FIG. 1 is a prior art block diagram of an engine water cooling system.
Figure 3:
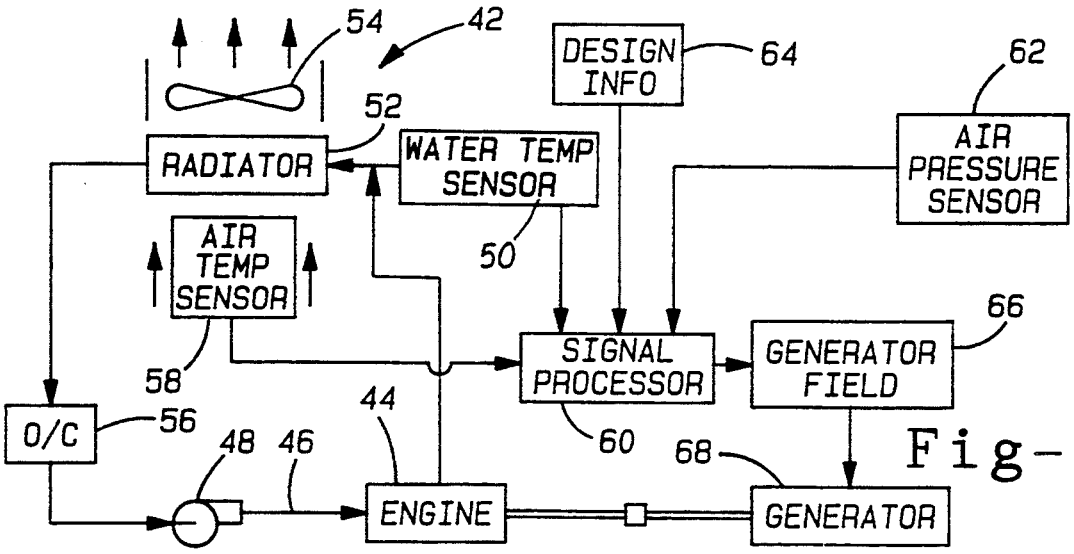
FIG. 3 is a block diagram of an engine water cooling system according to a preferred embodiment of the present invention.

Turning to FIG. 3, a locomotive engine water cooling system 42, according to a preferred embodiment of the present invention for cooling a locomotive engine 44, is shown in a block diagram form. The following discussion concerning the water cooling system 42 will also be described with reference to the design requirements of the F59PHMI locomotive, as an example, but it will be understood that the inventive concept is equally applicable to other locomotive cooling systems. The water cooling system 42 includes a water loop 46, a water pump 48, a water temperature sensor 50, a radiator 52 and associated fan 54, and an oil cooler 56. Each of these components operates in the same manner to the like components as described above with reference to FIG. 1, and as mentioned, are well understood in the art.

In order to yield the maximum power to a traction system (not shown) of the locomotive without exceeding the allowable temperature limits, the proposed cooling system 42 is designed to operate the engine 44 at the maximum power level corresponding to a present ambient air temperature without exceeding the maximum permissible engine cooling water temperature. In other words, the cooling system 42 of the present invention is designed to operate the engine 44 so that the cooling water temperature follows a particular CWTO line at high ambient temperatures. For reasons which will become apparent from the discussions below, the throttle notch 8 to 6 knock-down system, discussed above, is not eliminated in the present invention, but the actuation temperature of the water temperature sensor 50 that will cause the knock-down to the notch 6 position is increased to a value considerably higher than in the prior art. This temperature is below the water cavitation temperature of the pump 48. For a typical water cooling pump for use in a locomotive, this cavitation temperature would be about 232° F.

An air temperature sensor 58 is included as part of the water cooling system 42 for measuring ambient air temperature. In a preferred embodiment, the air temperature sensor 58 is positioned at the air inlet of the radiator 52, but it will be understood that the sensor 58 can be located at other locations and still be effective. An output signal of the air temperature sensor 58 is applied to a signal processor 60. The signal processor 60 may be part of a control computer of the locomotive, but other less complex signal processors would be equally applicable, as would be well understood in the art. Additionally, an ambient air pressure sensor 62 is included for measuring air pressure in order to provide altitude correction. An output signal of the pressure sensor 62 is also applied to the signal processor 60.

A system model of a thermal cooling load analysis including algorithms and data values is stored in a storage device 64. The system model algorithms and data values are preset for a particular locomotive in order to identify the correct power level of the engine 44 for the measured ambient air temperature and ambient air pressure with respect to the corresponding safe cooling water temperature. The appropriate system model for a particular locomotive which would maintain the cooling water constant could be calculated by one skilled in the art. Of course, the storage device 64 could be part of the signal processor 60. An output signal from the signal processor 60 adjusts the generator field 66 which in turn causes a generator 68 to increase or decrease the engine power, in the same manner as with the prior art system discussed above.

Figure 2:
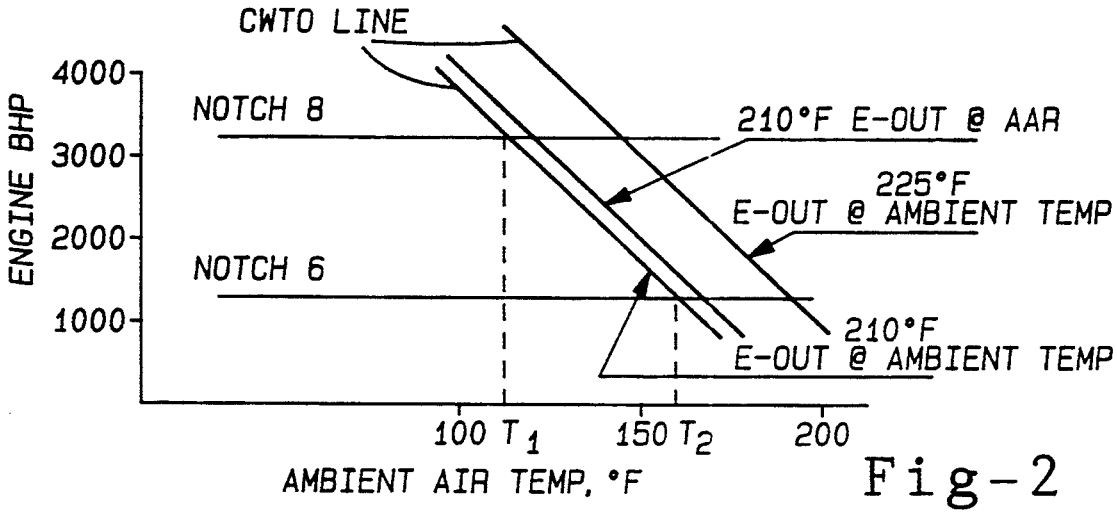
FIG. 2 is a graphical representation of engine power versus ambient air temperature.

The operation of the water cooling system 42 will now be described with reference to FIG. 2. Assume that the engine 44 is operating at the notch 8 power position. If the ambient air temperature is less than $T_1$ (110° F.) then the temperature of the cooling water would be below the maximum safe value, and the signal processor 60 would not restrict the engine power. If the air temperature does reach $T_1$, then a signal from the sensor 58 will cause the signal processor 60 to output a signal to the generator field 66 in accordance with the system model such that the power output of the engine 44 is reduced. The system model sets a reduction in the engine power that is only enough so that the temperature of the cooling water is substantially maintained at the value of the CWTO line of 210° F. in this example. If the ambient air temperature continues to go up, the sensor 58 will so indicate, and the signal processor 60 will again adjust the power output of the engine 44 such that the temperature of the cooling water is maintained constant. Likewise, when the ambient air temperature goes back down, the system 42 will cause the engine power to increase back towards the notch 8 power level in the same fashion.

The system model includes a correction factor Cf for the ambient pressure in order to provide a true value for the temperature of the cooling water. In other words, if the ambient pressure is below atmospheric pressure, i.e. at high altitudes, a particular temperature will have less cooling effect due to the reduced volume of air flowing through the fan 54 at these altitudes. Therefore, the engine power will need to be reduced the corrected amount in order to get a true cooling effect. The correction factor Cf is calculated for the effects of reduced ambient pressure as part of the system model as:

$$Cf=f(P)$$

where f(P) is a functional relationship built into the system model. As an example, for the F59PHMI locomotive the functional relationship f (P) is:

$$X=P/29.92$$

$$CF=X^{(A+BX)}$$

where P is the measured air pressure and A and B are constant values.

Note that two CWTO lines are given for 210° F. at the engine output (E-OUT) of the cooling water. The upper 210° F. CWTO line is the engine power at the American Association of Railroads (AAR) designated ambient pressure (28.86" HG) and temperature (60° F.), while the lower 210° F. CWTO line is the power of the same engine at the observed ambient temperature. At the AAR specified condition, the observed engine power is the same as the AAR engine power. With increasing ambient temperature or decreasing ambient pressure, the observed engine power becomes less than the AAR engine power. Therefore, in the system model, provisions are to be made for the correction of the engine power for ambient temperature and pressure. In FIG. 2, the "E-OUT @ AMBIENT TEMP" CWTO line includes the correction for ambient temperature. It only needs the pressure correction. This is only one method to demonstrate the implementation of corrections. Other forms of correction methods can be devised.

Different applications of the above-described process can provide the desired result without departing from the scope of the invention. For example, the signal processor 60 may either be an analog or a digital device.

Further, the process of derating the engine power may be substantially continuous along the CWTO line, or it is possible that the engine derating procedure may be a step function. In the step function procedure, once an ambient air temperature is sensed that will increase the cooling water above the maximum value, the signal processor 60 will reduce the engine power an amount that would in effect cause the temperature of the cooling water to decrease a little bit below the CWTO line. In this application, the signal processor 60 would wait for the cooling water temperature to again be increased to the maximum value before reducing the engine power another stepped amount.

As mentioned above, the cooling system according to the preferred embodiment of the present invention maintains the throttle notch 8 to 6 knock-down procedure known in the art. In the proposed system, the throttle notch 8 to 6 knock-down procedure is intended to be an additional safety feature if the proposed system or components discussed above fails. In this regard, the cooling water temperature that would cause the engine derating to drop to a notch 6 position may be increased to a value of approximately 225° F.–230° F. in accordance with the cavitation temperature limit of the water pump 48. This is shown as the 225° F E-OUT @ AMBIENT TEMP CWTO line in FIG. 2. Therefore, if for some reason the proposed engine derating system does not reduce engine power as the ambient air temperature rises, then once the cooling water temperature reaches a predetermined value, the system will automatically reduce the engine power to the notch 6 level, thus providing satisfactory reduction in engine power to reduce the cooling water temperature.

The water cooling system 42, as just described, is an open loop system in that the measurement of the ambient air temperature is the controlling variable and the engine-out water temperature is one of the controlled variables. The system response is not restricted by the loop characteristics in the thermal inertia of the water and the engine mass. Because there is no feedback loop, the stability of the control system does not constitute a problem. The stability is limited by the components of the signal processing, the generator power control and the engine fuel control components.

Instead of an open loop control system, a closed loop system could also be used in that a temperature signal from the water temperature sensor 50 would cause the signal processor 60 to reduce the engine power. When the ambient temperature increases beyond the temperature necessary to provide adequate cooling, a signal from the water temperature sensor 50 would provide an indication of the rise in the actual water temperature to the signal processor 60. The signal processor 60 would generate an error signal indicating the difference between the predetermined safe water temperature and the measured water temperature. The signal processor 60 would then apply a correction signal to the generator field 66 so as to cause the engine power to decrease in order to reduce the error signal to zero. In the closed loop system, the air temperature sensor 58 and the air pressure sensor 62 can be eliminated. Further, the built in system model may also be eliminated in that the signal processor 60 is merely generating an error signal as a difference between the measured cooling water temperature and the maximum cooling water temperature.

This type of closed-loop feedback control system will attempt to follow the CWTO line, but due to inherent characteristics of closed loop systems, there would be an error for proper operation which possibly could cause some deviation from the actual CWTO line. The signal processor 60 may use any one or combination of the presently available state of the art feedback control system design methods such as linear, non-linear, first and second derivative controls, as well as different signal processing media.

If the air being circulated by the fan 54 includes air of different temperatures, the air sensor 58 and the signal processor 60 may respond too fast, which in turn may cause undesirable changes in oscillating the generator power. Such a problem can be eliminated by making the air temperature sensor's response time longer or by any number of methods of signal processing available in the art. These methods may include using integrated versions of the sensor signal for certain durations, filtering the small fluctuations in the air temperature signal, and calculating different functionals from the signal and using it for the control input. Additionally, although the above-described procedure relies on the air temperature measurement, it is possible to incorporate the basic idea of operating the engine power on the CWTO line through other measurements, such as the engine cooling water temperature, or engine oil temperature.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A cooling system for cooling a locomotive engine associated with a locomotive, said engine generating power to drive the locomotive, said cooling system comprising:

circulating means for circulating a cooling medium through the locomotive engine;

air sensor means for sensing the temperature of ambient air proximate the locomotive, said air sensor means generating a signal indicative of the ambient air temperature; and signal processor means for causing the engine power to decrease in relation to an increase in the ambient air temperature once the ambient air temperature reaches a predetermined air temperature value, said signal processor means being responsive to the signal from the air sensor means and causing the engine to operate at a power level that will maintain the temperature of the cooling medium substantially at a first predetermined cooling medium value.

2. The cooling system according to claim 1 further comprising a cooling medium sensor, said cooling medium sensor being positioned proximate to the circulating means to sense the temperature of the cooling medium, said cooling medium sensor generating a signal indicative of the temperature of the cooling medium.

3. The cooling system according to claim 2 wherein the signal processor means receives the signal from the cooling medium sensor and causes the engine power to decrease to a predetermined engine power level if the temperature of the cooling medium increases above a second predetermined cooling medium value, said first predetermined cooling medium value being lower than said second predetermined cooling medium value, wherein the predetermined engine power level causes the temperature of the cooling medium to drop significantly below the first predetermined cooling medium value.

4. The cooling system according to claim 1 wherein the signal processor means includes storage means for storing system models of a thermal cooling load analysis that will identify the power level of the locomotive engine in relation to the ambient air temperature that will maintain the cooling medium substantially constant, wherein the signal processor means uses the system models to act on the signal from the air sensor means to cause the temperature of the cooling medium to remain substantially constant.

5. The cooling system according to claim 1 further comprising pressure sensing means for measuring the ambient pressure proximate to the locomotive, said pressure sensing means generating a signal indicative of the ambient pressure, said signal processor means receiving the signal from the pressure sensor means and combining the signal from the pressure sensor means and the air sensor means to determine the engine power.

6. The cooling system according to claim 1 wherein the signal processor means causes the engine power to decrease in a stepped manner relative to increases in the ambient air temperature.

7. The cooling system according to claim 1 further comprising a radiator and associated radiator fan, said circulating means transferring the cooling medium to the radiator, said radiator fan causing the ambient air to travel through the radiator and cool the cooling medium within the radiator.

8. The cooling system according to claim 7 wherein the circulating means includes a water pump and wherein the cooling medium is water, said water pump circulating the water through the engine and the radiator in a closed loop manner such that the water is heated by the engine and is cooled by the radiator.

9. The cooling system according to claim 7 wherein the air sensor means is located proximate to the radiator.

10. The cooling system according to claim 1 further comprising a generator and associated generator field, said signal processor means modifying the generator field in order to reduce the engine power.

11. A cooling system for cooling an engine associated with a vehicle, said engine generating power to drive the vehicle, said cooling system comprising:

circulating means for circulating a cooling medium through the engine; and signal processor means for causing the engine power to decrease in relation to an increase in the temperature of the cooling medium once the temperature of the cooling medium increases above a predetermined maximum value, said signal processor means continually reducing the engine power to a reduced engine power that will maintain the temperature of the cooling medium substantially constant at the predetermined maximum value as the temperature of the cooling medium increases.

12. The cooling system according to claim 11 further comprising air sensor means for sensing the temperature of the ambient air around the engine, said air sensor means generating a signal indicative of the ambient air temperature and sending the signal to the signal processor means, wherein the signal processor means uses the signal from the air sensor means along with a system model to determine the temperature of the cooling medium, said system model identifying the power level of the engine in relation to the ambient air temperature that will maintain the temperature of the cooling medium substantially constant.

13. The cooling system according to claim 11 further comprising cooling medium sensor means for sensing the temperature of the cooling medium, said cooling medium sensing means generating a signal indicative of the temperature of the cooling medium and sending the signal to the signal processor means, wherein the signal processor means is responsive to the signal from the cooling medium sensor means to cause the engine power to change in accordance with the temperature of the cooling medium.

14. The cooling system according to claim 11 further comprising pressure sensing means for measuring the ambient pressure around the engine, said pressure sensing means generating a signal indicative of the ambient pressure, said signal processor means being responsive to the signal from the pressure sensor means so as to calculate an engine power level value at least partially based on the ambient pressure for determining the engine power.

15. A method for cooling a locomotive engine associated with a locomotive, said method comprising the steps of:

circulating a cooling medium through the locomotive engine;

determining the temperature of the cooling medium; and decreasing the engine power to a reduced engine power once the temperature of the cooling medium increases above a predetermined temperature value, said step of decreasing the engine power to the reduced engine power including continually decreasing the engine power to an engine power level that will maintain the temperature of the cooling medium substantially constant at the predetermined value as the temperature of the cooling medium increases.

16. The method according to claim 15 wherein the step of determining the temperature of the cooling medium includes measuring the temperature of the ambient air around the locomotive engine and applying a signal indicative of the ambient air temperature to a signal processor where the signal processor uses a system model to determine the temperature of the cooling medium.

17. The method according to claim 15 wherein the step of determining the temperature of the cooling medium includes measuring the temperature of the cooling medium.

18. The method according to claim 16 wherein the step of determining the temperature of the cooling medium includes the steps of measuring the ambient pressure around the locomotive, and applying the measured ambient pressure to the signal processor in order to determine the engine power, wherein the temperature of the cooling medium is at least partially based on the ambient pressure.

19. The method according to claim 16 wherein the step of circulating a cooling medium through the locomotive engine includes the steps of circulating the cooling medium through a radiator and using a radiator fan to cause ambient air to flow over the cooling medium in order to reduce the temperature of the cooling medium, and said step of measuring the temperature of the ambient air includes positioning an air sensor proximate to the radiator.

20. The method according to claim 15 wherein the step of reducing the engine power includes the steps of generating a signal by a signal processor indicative of a decrease in the engine power and applying the signal to a generator field of a generator, wherein the generator controls the output power of the engine.

21. The method according to claim 15 wherein the step of reducing the engine power to maintain the temperature of the cooling medium at the predetermined value includes reducing the engine power in a stepped manner relative to increases in the temperature of the cooling medium.

22. A cooling system for cooling a locomotive engine associated with a locomotive, said engine generating power to drive the locomotive, said cooling system comprising:

circulating means for circulating a cooling fluid through the locomotive engine;

cooling fluid sensor means for sensing the temperature of the cooling fluid circulating through the circulating means, said cooling fluid sensor means generating a signal indicative of the temperature of the cooling fluid; and signal processor means for causing the engine power to decrease in relation to an increase in the cooling fluid once the cooling fluid temperature increases higher than a predetermined temperature, said signal processor means receiving the signal from the cooling fluid sensor means and generating an error signal as the difference between the measured temperature of the cooling fluid and the predetermined temperature, said signal processor means causing the engine power to be reduced in a manner that will reduce the error signal substantially to zero such that the temperature of the cooling medium remains substantially at the predetermined temperature.

* * * * *